US008951362B2

(12) United States Patent
Cheng et al.

(10) Patent No.: US 8,951,362 B2
(45) Date of Patent: Feb. 10, 2015

(54) REPLENISHING COMPOSITIONS AND METHODS OF REPLENISHING PRETREATMENT COMPOSITIONS

(75) Inventors: Shan Cheng, Sewickley, PA (US); James D. Chant, North Olmsted, OH (US); Nicephoros A. Fotinos, Lyndhurst, OH (US); Mark McMillen, Cabot, PA (US); Edward F. Rakiewicz, Gibsonia, PA (US); David A. Raney, Brook Park, OH (US)

(73) Assignee: PPG Industries Ohio, Inc., Cleveland, OH (US)

( * ) Notice: Subject to any disclaimer, the term of this patent is extended or adjusted under 35 U.S.C. 154(b) by 667 days.

(21) Appl. No.: 12/575,731

(22) Filed: Oct. 8, 2009

(65) Prior Publication Data

US 2011/0083580 A1 Apr. 14, 2011

(51) Int. Cl.
*C23C 22/48* (2006.01)
*C23C 22/00* (2006.01)

(52) U.S. Cl.
USPC ..... 148/247; 106/14.11; 148/243; 148/277

(58) Field of Classification Search
CPC ..... C23C 22/34; C23C 22/361
USPC ..... 148/247, 243, 277; 106/14.11
See application file for complete search history.

(56) References Cited

U.S. PATENT DOCUMENTS

| | | | |
|---|---|---|---|
| 3,682,713 | A | 8/1972 | Ries |
| 4,370,177 | A | 1/1983 | Frelin |
| 4,617,068 | A | 10/1986 | King |
| 5,281,282 | A | 1/1994 | Dolan et al. |
| 5,356,490 | A | 10/1994 | Dolan et al. |
| 5,534,082 | A | 7/1996 | Dollman et al. |
| 5,769,967 | A | 6/1998 | Dolan |
| 5,873,952 | A | 2/1999 | Hall |
| 5,897,716 | A | 4/1999 | Reghi et al. |
| 5,952,049 | A | 9/1999 | Tomlinson |
| 6,464,800 | B1 | 10/2002 | Carlson et al. |
| 6,736,908 | B2 | 5/2004 | Sako et al. |
| 6,758,916 | B1 | 7/2004 | McCormick |
| 6,764,553 | B2 | 7/2004 | Dolan |
| 6,797,147 | B2 | 9/2004 | Dolan |
| 6,881,279 | B2 | 4/2005 | Meagher et al. |
| 7,063,735 | B2 | 6/2006 | Fristad et al. |
| 7,175,882 | B2 | 2/2007 | Dolan et al. |
| 7,332,021 | B2 | 2/2008 | Fristad et al. |
| 2002/0122886 | A1 | 9/2002 | Dolan et al. |
| 2003/0215653 | A1* | 11/2003 | Liu et al. ..... 428/472 |
| 2006/0172064 | A1 | 8/2006 | Kolberg et al. |
| 2008/0057304 | A1 | 3/2008 | Fristad et al. |
| 2009/0232996 | A1* | 9/2009 | Goodreau et al. ..... 427/419.8 |

FOREIGN PATENT DOCUMENTS

| | | |
|---|---|---|
| CN | 1811014 | 8/2006 |
| EP | 0032306 | 7/1981 |
| EP | 0728225 | 12/1999 |
| EP | 0824565 | 7/2001 |
| GB | 1483283 | 8/1977 |
| RU | 2261291 C1 | 9/2005 |
| SU | 1465464 A1 | 3/1989 |
| WO | 85/05131 | 11/1985 |
| WO | 94/12570 | 6/1994 |
| WO | 95/14539 | 6/1995 |
| WO | WO 00/26437 | 5/2000 |
| WO | WO 2006/047500 | 5/2006 |
| WO | 2009/117397 | 9/2009 |

* cited by examiner

*Primary Examiner* — Lois Zheng
(74) *Attorney, Agent, or Firm* — Alicia M. Passerin, Esq.

(57) ABSTRACT

Disclosed are replenisher compositions and methods of replenishing pretreatment compositions. The methods include adding a replenisher composition to a pretreatment composition wherein the replenisher composition includes: (a) a dissolved complex metal fluoride ion wherein the metal ion comprises a Group IIIA metal, Group IVA metal, Group IVB metal, or combinations thereof; (b) a component comprising an oxide, hydroxide, or carbonate of Group IIIA, Group IVA, Group IVB metals, or combinations thereof; and optionally (c) a dissolved metal ion comprising a Group IB metal, Group IIB metal, Group VIIB metal, Group VIII metal, Lanthanide Series metal, or combinations thereof.

25 Claims, No Drawings

REPLENISHING COMPOSITIONS AND METHODS OF REPLENISHING PRETREATMENT COMPOSITIONS

FIELD OF THE INVENTION

The present invention relates to replenishing compositions and methods of replenishing pretreatment compositions.

BACKGROUND INFORMATION

The use of protective coatings on metal surfaces for improved corrosion resistance and paint adhesion characteristics is well known in the metal finishing arts. Conventional techniques involve pretreating metal substrates with phosphate pretreatment coating compositions and chrome-containing rinses for promoting corrosion resistance. The use of such phosphate and/or chromate-containing compositions, however, gives rise to environmental and health concerns. As a result, chromate-free and/or phosphate-free pretreatment compositions have been developed. Such compositions are generally based on chemical mixtures that in some way react with the substrate surface and bind to it to a form protective layer.

During a typical pretreatment process, as a pretreatment composition is contacted with a substrate, certain ingredients, such as metal ions in the pretreatment composition, bind to the substrate's surface to form a protective layer; as a result the concentration of those ions in the composition may be diminished during the process. Accordingly, it would be desirable to provide a method of replenishing a pretreatment composition with a replenisher composition which replenishes desired ingredients, such as metal, to the pretreatment composition.

SUMMARY OF THE INVENTION

In certain respects, the present invention is directed to a method of replenishing a pretreatment composition comprising adding a replenisher composition to the pretreatment composition, wherein the replenisher composition comprises: (a) a dissolved complex metal fluoride ion wherein the metal ion comprises a Group IIIA metal, Group IVA metal, Group IVB metal, or combinations thereof; and (b) a component comprising an oxide, hydroxide, or carbonate of Group IIIA metals, Group IVA metals, Group IVB metals, or combinations thereof.

In other respects, the present invention is directed to a method of replenishing a pretreatment composition comprising: adding a replenisher composition to the pretreatment composition, wherein the replenisher composition comprises: (a) a component comprising $H_2TiF_6$, $H_2ZrF_6$, $H_2HfF_6$, $H_2SiF_6$, $H_2GeF_6$, $H_2SnF_6$, or combinations thereof; and (b) a component comprising an oxide, hydroxide, or carbonate of titanium, zirconium, hafnium, aluminum, silicon, germanium, tin, or combinations thereof.

DETAILED DESCRIPTION

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Unless otherwise indicated, as used herein, "substantially free" means that a composition comprises ≤1 weight percent, such as ≤0.8 weight percent or ≤0.5 weight percent or ≤0.05 weight percent or ≤0.005 weight percent, of a particular material (e.g., organic solvent, filler, etc. . . . ) based on the total weight of the composition.

Unless otherwise indicated, as used herein, "completely free" means that a composition does not comprise a particular material (e.g., organic solvent, filler, etc. . . . ). That is, the composition comprises 0 weight percent of such material.

As previously mentioned, certain embodiments of the present invention are directed to methods of replenishing pretreatment compositions comprising adding a replenisher composition to a pretreatment composition. As used herein, the term "replenisher composition" refers to a material added to a pretreatment composition during the pretreatment process. In certain embodiments, the replenisher composition does not have the same formulation as the pretreatment composition although certain components of the formulation may be the same. For example, while both the replenisher composition and the pretreatment composition may both comprise the same material for components (a) and (i) (component (i) is described in greater detail below), respectively, the replenisher composition further comprises component (b) which the pretreatment composition lacks. By way of illustration, both the replenisher composition and the pretreatment composition may comprise $H_2ZrF_6$ as components (a) and (i), respectively. The replenisher composition further comprises component (b), which can be zirconium basic carbonate. The pretreatment composition, however, would be completely free of zirconium basic carbonate since it does not comprise a material that is identical (same) to that of component (b) of the replenisher composition.

Moreover, the present invention is not directed to simply adding more pretreatment composition to a pretreatment bath, which comprises the pretreatment composition, in order to replenish the bath. Rather, it is directed to adding a replenisher composition to a pretreatment composition wherein the replenisher composition has a different formulation from that of the pretreatment composition. As stated above, in certain embodiments, the pretreatment composition may be a component of a pretreatment bath.

In certain embodiments, the replenisher composition of certain methods of the present invention comprises: (a) a dissolved complex metal fluoride ion wherein the metal ion comprises a Group IIIA metal, Group IVA metal, Group IVB metal, or combinations thereof; and (b) a component comprising an oxide, hydroxide, or carbonate of Group IIIA, Group IVA, Group IVB metals, or combinations thereof.

The metal ions and metals referred to herein are those elements included in such designated group of the CAS Periodic Table of the Elements as is shown, for example, in *Hawley's Condensed Chemical Dictionary,* 15$^{th}$ Edition (2007).

As mentioned, in certain embodiments, the replenisher composition comprises (a) a dissolved complex metal fluoride ion wherein the metal ion comprises a Group IIIA metal, Group IVA, Group IVB metal, or combinations thereof. The metal can be provided in ionic form, which can be easily dissolved in an aqueous composition at an appropriate pH, as would be recognized by those skilled in the art. The metal may be provided by the addition of specific compounds of the metals, such as their soluble acids and salts. The metal ion of the dissolved complex metal fluoride ion is capable of converting to a metal oxide upon application to a metal substrate. In certain embodiments, the metal ion of the (a) dissolved complex metal fluoride ion comprises silicon, germanium, tin, boron, aluminum, gallium, indium, thallium, titanium, zirconium, hafnium, or combinations thereof.

As mentioned, a source of fluoride ion is also included in component (a) to maintain solubility of the metal ions in solution. The fluoride may be added as an acid or as a fluoride salt. Suitable examples include, but are not limited to, ammonium fluoride, ammonium bifluoride, hydrofluoric acid, and the like. In certain embodiments, the dissolved complex metal fluoride ion is provided as a fluoride acid or salt of the metal. In these embodiments, the complex fluoride ion provides both a metal as well as a source of fluoride to the replenisher composition. Suitable examples include, but are not limited to, fluorosilicic acid, fluorozirconic acid, fluorotitanic acid, ammonium and alkali metal fluorosilicates, fluorozirconates, fluorotitanates, zirconium fluoride, sodium fluoride, sodium bifluoride, potassium fluoride, potassium bifluoride, and the like.

In certain embodiments, the dissolved complex metal fluoride ion component (a) of the replenisher composition comprises $H_2TiF_6$, $H_2ZrF_6$, $H_2HfF_6$, $H_2SiF_6$, $H_2GeF_6$, $H_2SnF_6$, or combinations thereof.

As mentioned, the replenisher composition of the methods of the present invention comprises a component (b) comprising an oxide, hydroxide, carbonate of Group IIIA metals, Group IVA metals, Group IVB metals, or combinations thereof. Salts of such compounds may also be used. Similar to above, the metals of Groups IIIA, IVA, and IVB are selected from the CAS Periodic Table of the Elements. Suitable examples of Group IIIA, Group IVA, Group IVB metals include, but are not limited to, aluminum, gallium, indium, thallium, silicon, germanium, tin, lead, titanium, zirconium, hafnium, and the like. In certain embodiments, the metal ion of component (b) comprises titanium, zirconium, hafnium, aluminum, silicon, germanium, tin, or combinations thereof. In other embodiments, component (b) of the replenisher composition comprises zirconium basic carbonate, aluminum hydroxide, tin oxide, silicon hydroxide, or combinations thereof.

In certain embodiments, the dissolved complex metal fluoride ion component (a) of the replenisher composition is present in the replenisher composition in an amount ranging from 10 to 92 percent by weight metal ions based on the weight of total metal ions of components (a) and (b) of the replenisher composition. In other embodiments, the dissolved complex metal fluoride ion component (a) of the replenisher composition is present in the replenisher composition in an amount ranging from 50 to 90 percent by weight metal ions, such as from 65 to 90 percent by weight metal ions based on the weight of total metal ions of components (a) and (b) of the replenisher composition.

In certain embodiments, at least 8 percent by weight of the metal ions of components (a) and (b) together are provided by the metal ions of component (b). In other embodiments, component (b) is present in the replenisher composition in an amount ranging from 8 to 90 percent by weight metal ions based on the weight of total metal ions of components (a) and (b) of the replenisher composition. In still other embodiments, component (b) is present in the replenisher composition in an amount ranging from 10 to 35 percent by weight metal ions based on the weight of total metal ions of components (a) and (b) of the replenisher composition In certain embodiments, the replenisher composition may, optionally, further comprise (c) a dissolved metal ion comprising a Group IB metal, Group IIB metal, Group VIIB metal, Group VIII metal, Lanthanide Series metal, or combinations thereof. Similar to above, the metals of Group IB, Group IIB, Group VIIB, Group VIII, and Lanthanide Series are selected from the CAS Periodic Table of the Elements.

In certain embodiments, the dissolved metal ion (c) comprises manganese, cerium, cobalt, copper, zinc, iron, or combinations thereof. Water-soluble forms of metals can be utilized as a source of the metal ions comprising a Group IB metal, Group IIB metal, Group VIIB metal, Group VIII metal, and/or Lanthanide Series metal. Suitable compounds include, but are not limited to, ferrous phosphate, ferrous nitrate, ferrous sulfate, copper nitrate, copper sulfate, copper chloride, copper sulfamate, zinc nitrate, zinc sulfate, zinc chloride, zinc sulfamate, and the like.

In certain embodiments, component (c) is present in the replenisher composition at a weight ratio of 1:10 to 10:1 based on the weight of total metal ions of components (a) and (b) to the weight of total metal ions of component (c). In other embodiments, component (c) is present at a weight ratio of 1:6 to 6:1, such as from 1:4 to 4:1 based on the weight of total metal ions of components (a) and (b) to the weight of total metal ions of component (c).

In certain embodiments, the replenisher composition of the methods of the present invention is provided as an aqueous solution and/or dispersion. In these embodiments, the replenisher composition further comprises water. Water may be used to dilute the replenisher composition used in the methods of the present invention. Any appropriate amount of water may be present in the replenisher composition to provide the desired concentration of other ingredients.

The pH of the replenisher composition may be adjusted to any desired value. In certain embodiments, the pH of the replenisher composition may be adjusted by varying the amount of the dissolved complex metal fluoride ion present in the composition. In other embodiments, the pH of the replenisher composition may be adjusted using, for example, any acid or base as is necessary. In certain embodiments, the pH of the replenisher is maintained through the inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or combinations thereof.

In certain embodiments, the replenisher composition of the methods of the present invention is prepared by combining component (a), component (b), and water to form a first preblend. The ingredients of the first preblend may be agitated under mild agitation once the ingredients are combined with one another. Next, if component (c) is present, component (c) and water may be combined to form a second preblend. The ingredients of the second preblend may be agitated under mild agitation once the ingredients are combined with one another. The first preblend may then be added to the second preblend. Once the first and second preblends are combined, they may be agitated under mild agitation. The replenisher composition may be prepared at ambient conditions, such as approximately 70° F. to 80° F. (21 to 26° C.), or at temperatures slightly below and/or slightly above ambient conditions, such as from approximately 50° F. to 140° F. (10 to 60° C.).

As mentioned, the methods of the present invention are directed toward adding a replenisher composition to a pretreatment composition. As used herein, the term "pretreatment composition" refers to a composition that upon contact with a substrate, reacts with and chemically alters the substrate surface and binds to it to form a protective layer.

In certain embodiments, the pretreatment composition of the methods of the present invention comprises water and (i) a dissolved complex metal fluoride ion wherein the metal ion comprises a Group IIIA metal, Group IVA metal, Group IVB metal, Group VB metal or combinations thereof.

The dissolved complex metal fluoride ion (i) of the pretreatment composition may be any of those described above related to the dissolved complex metal fluoride ion (a) of the replenisher composition. In certain embodiments, the dissolved complex metal fluoride ion (i) of the pretreatment composition is different from the dissolved complex metal fluoride ion (a) of the replenisher composition. In other embodiments, the dissolved complex metal fluoride ion (i) of the pretreatment composition is the same as the dissolved complex metal fluoride ion (a) of the replenisher composition.

In certain embodiments, the metal ion of the dissolved complex metal fluoride ion of the pretreatment composition comprises titanium, zirconium, hafnium, silicon, germanium, tin, or combinations thereof. In certain embodiments, the dissolved complex metal fluoride ion of component (i) of the pretreatment composition comprises $H_2TiF_6$, $H_2ZrF_6$, $H_2HfF_6$, $H_2SiF_6$, $H_2GeF_6$, $H_2SnF_6$, or combinations thereof.

In certain embodiments, the dissolved complex metal fluoride ion (i) is present in the pretreatment composition in an amount to provide a concentration of from 10 ppm ("parts per million") to 250 ppm metal ions (measured as elemental metal), such as from 30 ppm to 200 ppm metal ions, such as from 150 ppm to 200 ppm metal ions in the pretreatment composition.

In certain embodiments, the pretreatment composition may, optionally, further comprise (ii) a dissolved metal ion comprising a Group IB metal, Group IIB metal, Group VIIB metal, Group VIII metal, Lanthanide Series metal, or combinations thereof. The dissolved metal ion (ii) of the pretreatment composition, if used, may be any of those described above related to the dissolved metal ion (c) of the replenisher composition. In certain embodiments, the dissolved metal ion (ii) of the pretreatment composition is different from the dissolved metal ion (c) of the replenisher composition. In other embodiments, the dissolved metal ion (ii) of the pretreatment composition is the same as the dissolved metal ion (c) of the replenisher composition.

In some embodiments, if the pretreatment composition comprises the dissolved metal ion of component (ii), then the replenisher composition will comprise the dissolved metal ion of component (c). Alternatively, in some embodiments, if the pretreatment composition does not comprise the dissolved metal ion of component (ii), then the replenisher composition may or may not comprise the dissolved metal ion of component (c).

In certain embodiments, the dissolved metal ion (ii) of the pretreatment composition comprises manganese, cerium, cobalt, copper, zinc, or combinations thereof. Suitable compounds include, but are not limited to, ferrous phosphate, ferrous nitrate, ferrous sulfate, copper nitrate, copper sulfate, copper chloride, copper sulfamate, zinc nitrate, zinc sulfate, zinc chloride, zinc sulfamate, and the like.

In certain embodiments, the dissolved metal ion (ii) is present in the pretreatment composition in an amount to provide a concentration of from 5 ppm to 100 ppm metal ions (measured as elemental metal), such as from 10 ppm to 60 ppm metal ions in the pretreatment composition.

As mentioned, the pretreatment composition also comprises water. Water may be present in the pretreatment composition at any appropriate amount to provide the desired concentration of other ingredients.

In certain embodiments, the pretreatment composition comprises materials which are present to adjust pH. In certain embodiments, the pH of the pretreatment composition ranges from 2.0 to 7.0, such as from 3.5 to 6.0. The pH of the pretreatment composition described here relates to the pH of the composition prior to contacting the pretreatment composition with a substrate during the pretreatment process. The pH of the pretreatment composition may be adjusted using, for example, any acid or base as is necessary. In certain embodiments, the pH of the pretreatment composition is maintained through inclusion of a basic material, including water soluble and/or water dispersible bases, such as sodium hydroxide, sodium carbonate, potassium hydroxide, ammonium hydroxide, ammonia, and/or amines such as triethylamine, methylethyl amine, or combinations thereof The pretreatment composition may optionally contain other materials, including but not limited to nonionic surfactants, water dispersible organic solvents, defoamers, wetting agents, fillers, and resinous binders.

Suitable water dispersible organic solvents and their amounts are described in U.S. Patent Application Pub. No. 2009/0032144A1, paragraph [0039], the cited portion being incorporated herein by reference. In other embodiments, the pretreatment composition is substantially free or, in some cases, completely free of any water dispersible organic solvents.

Suitable resinous binders, as well as their weight percents, which may be used in connection with the pretreatment composition disclosed herein are described in U.S. Patent Application Pub. No. 2009/0032144A1, paragraph [0036] through paragraph [0038], the cited portion being incorporated herein by reference.

Suitable fillers that may be used in connection with the pretreatment composition disclosed herein are described in U.S. Patent Application Pub. No. 2009/0032144A1, paragraph [0042], the cited portion being incorporated herein by reference. In other embodiments, the pretreatment composition is substantially free or, in some cases, completely free of any filler.

In certain embodiments, the pretreatment composition also comprises a reaction accelerator, such as nitrite ions, nitrate ions, nitro-group containing compounds, hydroxylamine sulfate, persulfate ions, sulfite ions, hyposulfite ions, peroxides, iron (III) ions, citric acid iron compounds, bromate ions, perchlorate ions, chlorate ions, chlorite ions as well as ascorbic acid, citric acid, tartaric acid, malonic acid, succinic acid and salts thereof. Specific examples of such materials, as well as their amounts in the pretreatment composition, are described in U.S. Patent Application Pub. No. 2009/0032144A1 at paragraph [0041] and in U.S. Patent Application Pub. No. 2004/0163736, paragraph [0032] through paragraph [0041], the cited portions being incorporated herein by reference. In other embodiments, the pretreatment composition is substantially free or, in some cases, completely free of a reaction accelerator.

In certain embodiments, the pretreatment composition also comprises phosphate ions. Suitable materials and their amounts are described in U.S. Patent Application Pub. No. 2009/0032144A1 at paragraph [0043], incorporated herein by reference. In certain embodiments, however, the pretreatment composition is substantially or, in some cases, completely free of phosphate ion. As used herein, the term "substantially free" when used in reference to the absence of phosphate ion in the pretreatment composition, means that phosphate ion is present in the composition in an amount less than 10 ppm. As used herein, the term "completely free", when used with reference to the absence of phosphate ions, means that there are no phosphate ions in the composition at all.

In certain embodiments, the pretreatment composition is substantially or, in some cases, completely free of chromate and/or heavy metal phosphate, such as zinc phosphate.

In certain embodiments of the methods of the present invention, the replenisher composition is added to the pretreatment composition at an amount sufficient to maintain the metal ions from the dissolved complex metal fluoride ion (i) at a concentration within 25 ppm (measured as elemental metal) of the initial concentration of the metal ions from the dissolved complex metal fluoride ion (i) prior to the pretreatment process. In other embodiments, the replenisher composition is added to the pretreatment composition at an amount sufficient to maintain the metal ions from the dissolved complex metal fluoride ion (i) at a concentration ranging from 10 ppm to 250 ppm metal ions, such as from 150 ppm to 200 ppm metal ions in the pretreatment composition. As those skilled in the art would recognize, the concentration of metal ions in the pretreatment composition may be monitored through the use of any suitable analytical methods, including for example, titrimetric methods, colorimetric methods, atomic absorption spectroscopy, and x-ray fluorescence methods.

In certain embodiments, the replenisher composition, including any of those compositions set forth above, is added to the pretreatment composition in an amount sufficient to maintain the pH of the pretreatment composition at a pH of 6.0 or below, such as at a pH of 5.5 or below, such as at a pH of 5.0 or below. In still other embodiments, the replenisher composition is added to maintain the pH of the pretreatment composition at a level of from 4.0 to 5.0, such as from 4.6 to 4.8.

In certain embodiments of the methods of the present invention, the replenisher composition may be added to the pretreatment composition under agitation. In other embodiments, the replenisher composition may be added to the pretreatment composition without agitation followed by agitation of the materials. The replenisher composition may be added to the pretreatment composition when the pretreatment composition is at ambient temperature, such as approximately 70° F. to 80° F. (21 to 26° C.), as well as when the pretreatment composition is at temperatures slightly below and/or slightly above ambient temperature, such as, for example, from approximately 50° F. to 140° F. (10 to 60° C.).

As would be recognized in the art, parameters of a pretreatment composition other than concentration of metal ions as described above, may be monitored during the pretreatment process, including for example pH and concentration of reaction products. As used herein, the term "reaction products" refers to soluble and/or insoluble substances that are formed during deposition of a pretreatment composition onto a substrate and from materials added to the pretreatment composition to control bath parameters, including the replenisher composition, and does not include the pretreatment film formed on the substrate. If any of these parameters fall outside of a desired concentration range, the effectiveness of depositing a metal compound onto a substrate can be impacted. For example, the pH of the pretreatment composition may decrease over time (e.g., become too acidic) which can impact the effectiveness of depositing metal compound onto the substrate.

Similarly, an increased concentration of reaction products present in a pretreatment composition can also interfere with proper formation of the pretreatment coating onto a substrate which can lead to poor properties, including corrosion resistance. For example, in some cases, as a metal compound is deposited onto a substrate's surface, fluoride ions associated with the metal compound can become dissociated from the metal compound and released into the pretreatment composition as free fluoride, and if left unchecked, will increase with time. As used herein, "free fluoride" refers to isolated fluoride ions that are no longer complexed and/or chemically associated with a metal ion and/or hydrogen ion, but rather independently exist in the bath. As used herein, "total fluoride" refers to the combined amount of free fluoride and fluoride that is complexed and/or chemically associated with a metal ion and/or hydrogen ion, i.e., fluoride which is not free fluoride. As will be appreciated by those skilled in the art, any suitable method for determining the concentration of free fluoride and total fluoride may be used, including for example, ion selective electrode analysis (ISE) using a calibrated meter capable of such measurements, such as an Accumet XR15 meter with an Orion Ionplus Sure-Flow Fluoride Combination electrode (available from Fisher Scientific).

In certain embodiments, the initial concentration of free fluoride of the pretreatment composition ranges from 10 to 200 ppm. In other embodiments, the initial concentration of free fluoride of the pretreatment composition ranges from 20 to 150 ppm.

In certain embodiments, a pH controller may be added to the pretreatment composition in addition to the replenisher composition to achieve a desired pH. Any suitable pH controller commonly known in the art may be used, including for example, any acid or base as is necessary. Suitable acids include, but are not limited to, sulfuric acid and nitric acid. Suitable water soluble and/or water dispersible bases include, but are not limited to, sodium hydroxide, sodium carbonate, potassium hydroxide, ammonium hydroxide, ammonia, and/or amines such as triethylamine, methylethyl amine, or combinations thereof. In certain embodiments, a pH controller may be added to the pretreatment composition during the pretreatment process to adjust the pH of the pretreatment composition to a pH of 6.0 or below, such as a pH of 5.5 or below, such as a pH of 5.0 or below. In other embodiments, the pH controller may be added to adjust the pH to a level of from 4.0 to 5.0, such as from 4.6 to 4.8.

In certain embodiments, the addition of the replenisher composition may maintain the pH of the pretreatment composition thereby reducing and/or eliminating the amount of pH controller that is added during the pretreatment process. In certain embodiments, addition of the replenisher composition results in addition of a pH controller at a lesser frequency during the pretreatment process. That is, addition of a pH controller to the pretreatment composition occurs a lesser number of times, compared to methods other than the present invention. In other embodiments, addition of the replenisher composition results in a lesser amount of a pH controller that is added to the pretreatment composition during the pretreatment process compared to the amount of a pH controller that is added according to methods other than the methods of the present invention.

In certain embodiments, the level of reaction product may be controlled through an overflow method, as would be recognized by those skilled in the art, in addition to the addition of the replenisher composition. In other embodiments, a reaction product scavenger may be added to the pretreatment composition in addition to the replenisher composition. As used herein, a "reaction product scavenger" refers to a material that, when added to a pretreatment composition during the pretreatment process, complexes with reaction products, for example free fluoride, present in the pretreatment composition, to remove the reaction products from the composition. Any suitable reaction product scavenger commonly known in the art may be used. Suitable reaction product scavengers include, but are not limited to, those described in U.S. Patent Application Pub. No. 2009/0032144A1, paragraphs [0032] through [0034], incorporated herein by reference.

In certain embodiments, the addition of the replenisher composition may result in lower concentrations of reaction products during the pretreatment process thereby reducing and/or eliminating the amount of a reaction product scavenger that is added to a pretreatment composition during the pretreatment process. In some embodiments, it is believed that because the concentration of reaction products is lower as a result of addition of the replenisher composition, the level of sludge which may build during the pretreatment process is reduced and/or eliminated, although the inventors do not wish to be bound by any particular theory.

In certain embodiments, addition of the replenisher composition results in addition of a reaction product scavenger at a lesser frequency during the pretreatment process. That is, addition of a reaction product scavenger to the pretreatment composition occurs a lesser number of times, compared to methods other than the methods of the present invention. In other embodiments, addition of the replenisher composition results in a lesser amount of a reaction product scavenger that is added to the pretreatment composition during the pretreatment process compared to the amount of a reaction product scavenger that is added according to methods other than the methods of the present invention.

In certain embodiments, the present invention is directed toward a method of replenishing a pretreatment composition comprising: (I) adding a replenisher composition to the pretreatment composition, wherein the replenisher composition consists essentially of: a) a dissolved complex metal fluoride ion wherein the metal ion comprises a Group IIIA metal, Group IVA metal, Group IVB metal, or combinations thereof; b) a component comprising an oxide, hydroxide, or carbonate of Group IIIA, Group IVA, Group IVB metals, or combinations thereof; and c) a dissolved metal ion comprising a Group IB metal, Group IIB metal, Group VIIB metal, Group VIII metal, Lanthanide Series metal, or combinations thereof, and wherein the pretreatment composition comprises: (i) a dissolved metal ion comprising a Group IB metal, Group IIB metal, Group VIIB metal, Group VIII metal, Lanthanide Series metal, or combinations thereof; (ii) a dissolved complex metal fluoride ion wherein the metal atom comprises a Group IIIA metal, Group IVA metal, Group IVB metal, Group VB metal, or combinations thereof; and water; and (II) agitating the blend of replenisher composition and pretreatment composition.

In certain embodiments, the present invention is directed toward a method of replenishing a pretreatment composition comprising: (I) adding a replenisher composition to the pretreatment composition, wherein the replenisher composition consists essentially of: a) a dissolved complex metal fluoride ion wherein the metal ion comprises a Group IIIA metal, Group IVA metal, Group IVB metal, or combinations thereof; and b) a component comprising an oxide, hydroxide, or carbonate of Group IIIA, Group IVA, Group IVB metals, or combinations thereof; and wherein the pretreatment composition comprises: (i) a dissolved metal ion comprising a Group IB metal, Group IIB metal, Group VIIB metal, Group VIII metal, Lanthanide Series metal, or combinations thereof; and water; and (II) agitating the blend of replenisher composition and pretreatment composition.

Other embodiments of the present invention are directed to a replenisher composition comprising: (a) a dissolved complex metal fluoride ion wherein the metal ion comprises a Group IIIA metal, Group IVA metal, Group IVB metal, or combinations thereof; and (b) a component comprising an oxide, hydroxide, or carbonate of Group IIIA, Group IVA, Group IVB metals, or combinations thereof, wherein at least 8 percent by weight of total metal ions of components (a) and (b) present in the replenisher composition are provided by component (b). Components (a) and (b) may be any of those mentioned above.

In certain embodiments, the replenisher composition further comprises: (c) a dissolved metal ion comprising a Group IB metal, Group IIB metal, Group VIIB metal, Group VIII metal, Lanthanide Series metal, or combinations thereof. The dissolved metal ion (c) may be any of those mentioned above.

In certain embodiments, the pretreatment composition replenished by the replenisher composition according to the methods of the present invention may be applied to a metal substrate. Suitable metal substrates for use in the present invention include those that are often used in the assembly of automotive bodies, automotive parts, and other articles, such as small metal parts, including fasteners, i.e., nuts, bolts, screws, pins, nails, clips, buttons, and the like. Specific examples of suitable metal substrates include, but are not limited to, cold rolled steel, hot rolled steel, steel coated with zinc metal, zinc compounds, or zinc alloys, such as electrogalvanized steel, hot-dipped galvanized steel, galvannealed steel, and steel plated with zinc alloy. Also, aluminum alloys, aluminum plated steel and aluminum alloy plated steel substrates may be used. Other suitable non-ferrous metals include copper and magnesium, as well as alloys of these materials. Moreover, the metal substrate may be a cut edge of a substrate that is otherwise treated and/or coated over the rest of its surface. The metal substrate may be in the form of, for example, a sheet of metal or a fabricated part.

The substrate may first be cleaned to remove grease, dirt, or other extraneous matter. This is often done by employing mild or strong alkaline cleaners, such as are commercially available and conventionally used in metal pretreatment processes. Examples of alkaline cleaners suitable for use in the present invention include CHEMKLEEN 163, CHEMKLEEN 177, and CHEMKLEEN 490MX, each of which are commercially available from PPG Industries, Inc. Such cleaners are often followed and/or preceded by a water rinse.

In certain embodiments, the pretreatment composition replenished according to the methods of the present invention may be brought into contact with the substrate by any of known techniques, such as dipping or immersion, spraying, intermittent spraying, dipping followed by spraying, spraying followed by dipping, brushing, or roll-coating. In certain embodiments, the pretreatment composition when applied to the metal substrate is at a temperature ranging from 50 to 150° F. (10 to 65° C.). The contact time is often from 10 seconds to five minutes, such as 30 seconds to 2 minutes.

In certain embodiments, the applied metal ion of the pretreatment coating composition generally ranges from 1 to 1000 milligrams per square meter ($mg/m^2$), such as 10 to 400 $mg/m^2$. The thickness of the pretreatment coating can vary, but it is generally very thin, often having a thickness of less than 1 micrometer, in some cases it is from 1 to 500 nanometers, and, in yet other cases, it is 10 to 300 nanometers.

Following contact with the pretreatment solution, the substrate may be rinsed with water and dried.

In certain embodiments, after the substrate is contacted with the pretreatment composition which has been replenished according to the methods of the present invention, it is then contacted with a coating composition comprising a film-forming resin. Any suitable technique may be used to contact the substrate with such a coating composition, including, for example, brushing, dipping, flow coating, spraying and the like. In certain embodiments, such contacting comprises an electrocoating step wherein an electrodepositable composition is deposited onto the metal substrate by electrodeposition.

As used herein, the term "film-forming resin" refers to resins that can form a self-supporting continuous film on at least a horizontal surface of a substrate upon removal of any diluents or carriers present in the composition or upon curing at ambient or elevated temperature. Conventional film-forming resins that may be used include, without limitation, those typically used in automotive OEM coating compositions, automotive refinish coating compositions, industrial coating compositions, architectural coating compositions, coil coating compositions, and aerospace coating compositions, among others.

In certain embodiments, the coating composition comprises a thermosetting film-forming resin. As used herein, the term "thermosetting" refers to resins that "set" irreversibly upon curing or crosslinking, wherein the polymer chains of the polymeric components are joined together by covalent bonds. This property is usually associated with a cross-linking reaction of the composition constituents often induced, for example, by heat or radiation. Curing or crosslinking reactions also may be carried out under ambient conditions. Once cured or crosslinked, a thermosetting resin will not melt upon the application of heat and is insoluble in solvents. In other embodiments, the coating composition comprises a thermoplastic film-forming resin. As used herein, the term "thermoplastic" refers to resins that comprise polymeric components that are not joined by covalent bonds and thereby can undergo liquid flow upon heating and are soluble in solvents.

As previously mentioned, the substrate may be contacted with a coating composition comprising a film-forming resin by an electrocoating step wherein an electrodepositable coating is deposited onto the metal substrate by electrodeposition. Suitable electrodepositable coating compositions include those described in U.S. Patent Application Pub. No. 2009/0032144A1, paragraph [0051] through paragraph [0082], the cited portion of which being incorporated herein by reference.

Illustrating the invention are the following examples that are not to be considered as limiting the invention to their details. All parts and percentages in the examples, as well as throughout the specification, are by weight unless otherwise indicated.

EXAMPLES

Example 1

A replenisher composition was prepared as follows. The amount of each of the ingredients present in the replenisher composition of Example 1 is reflected in Table 1 below. Each of the percentages is expressed by weight.

TABLE 1

| | |
|---|---|
| Hexafluorozirconic acid, 45% (available from Honeywell) | 5.6% |
| Zirconium basic carbonate (available from Blue Line Corporation) | 1.3% |
| Copper nitrate solution, 18% copper (available from Shepherd Chemical) | 1.8% |
| Deionized water | balance |

The following materials were used:

CHEMFIL BUFFER, alkaline buffer solution commercially available from PPG Industries, Inc.

CHEMKLEEN 166HP, alkaline cleaning product commercially available from PPG Industries, Inc.

CHEMKLEEN 171A, alkaline cleaning product commercially available from PPG Industries, Inc.

ZIRCOBOND CONTROL #4, commercially available from PPG Industries, Inc.

ZIRCOBOND R1, replenisher commercially available from PPG Industries, Inc.

A fresh zirconium pretreatment bath was prepared using 0.88 grams per liter of hexafluorozirconic acid (45%) and 1.08 grams per liter of a copper nitrate solution (concentration 2% copper by weight). The remainder of the bath was deionized water. The pH of the bath was adjusted to approximately 4.5 with CHEMFIL BUFFER.

Two 3.7 liter aliquots of the above pretreatment bath were tested as follows, one with ZIRCOBOND R1 and the other with the replenisher composition of Example 1. To test each of the replenishers, panels were pretreated in 3.7 liters of the pretreatment bath previously described to deplete it, and then each bath was adjusted using the appropriate replenisher.

The initial levels of zirconium and free fluoride were measured in each bath. The level of zirconium was measured by x-rite fluorescence. The initial zirconium level of the bath to be replenished with ZIRCOBOND R1 was approximately 187 ppm (measured as elemental metal). The initial zirconium level of the bath to be replenished with the replenisher composition of Example 1 was approximately 183 ppm (measured as elemental metal).

The initial levels of zirconium and free fluoride were measured in each bath. The level of zirconium was measured by x-ray fluorescence. The initial zirconium level of the bath to be replenished with ZIRCOBOND R1 was approximately 187 ppm (measured as elemental metal). The initial zirconium level of the bath to be replenished with the replenisher composition of Example 1 was approximately 183 ppm (measured as elemental metal).

Panels were prepared for processing through the baths as follows. The panels were cleaned for two (2) minutes by spray application in a 2% v/v solution of CHEMKLEEN 166HP with 0.2% CHEMKLEEN 171A added. The panels were rinsed by immersing for approximately ten (10) seconds into deionized water, followed by an approximately ten (10) second spray with deionized water.

A group of twenty (20) 4×6" panels were processed through each bath, the selection of panels consisted of: one (1) panel of aluminum (6111 T43); one (1) panel of cold rolled steel; two (2) hot dipped galvanized steel panels; and sixteen (16) electrogalvanized steel panels. The panels were immersed into the pretreatment bath for two (2) minutes at approximately 80° F. (28° C.), with mild agitation. Next, the panels were rinsed with an approximately 10-15 second spray with deionized water, and dried with a warm air blow-off.

After processing the first group of 20 panels through the bath, each of the pretreatment baths was measured for zirconium level, pH, and fluoride level using the methods described above.

Based on these measurements, ZIRCOBOND R1 and the replenisher composition of Example 1 was added to each respective bath to adjust the zirconium level of the bath back to the starting value. Adjustments to bring the pH within the range of 4.4-4.8 and free fluoride level within the range of from 40-70 ppm were also made, if any adjustment was necessary. The pH was adjusted (if necessary) by adding CHEMFIL BUFFER to each of the baths. Free fluoride was adjusted (if necessary) by adding ZIRCOBOND CONTROL #4 to each of the baths.

The bath depletion and replenishment process described above was continued in 20 panel groupings until a total of 300 panels had been treated in each bath. The amounts of ZIRCOBOND R1 and replenisher composition of Example 1, CHEMFIL BUFFER, and ZIRCOBOND CONTROL #4 added to each of the baths were recorded. Any sludge that formed in the baths was also collected and measured. The results are shown in Table 2 below:

TABLE 2

| | Bath Chemical Usage (grams) | | | Sludge |
|---|---|---|---|---|
| Replenisher Composition | Replenisher | Chemfil Buffer | Zircobond Control #4 | generated (grams) |
| ZIRCOBOND R1 | 54.3 g | 7.4 g | 8.7 g | 1.6 g |
| Example 1 | 48.9 g | 3.4 g | 3.1 g | 0.9 g |

Whereas particular embodiments of this invention have been described above for purposes of illustration, it will be evident to those skilled in the art that numerous variations of the details of the present invention may be made without departing from the invention as defined in the appended claims.

We claim:

1. A method of replenishing a spent pretreatment composition comprising:

adding to a pretreatment bath containing the spent pretreatment composition a replenisher composition having at least one component that is not present in a fresh pretreatment composition, wherein the replenisher composition comprises:

(a) a dissolved complex metal fluoride ion wherein the metal ion comprises a Group IIIA metal, Group IVA metal, Group IVB metal, or combinations thereof; and (b) a component comprising an oxide, hydroxide, carbonate of Group IIIA metals, Group IVA metals, Group IVB metals, or combinations thereof, and wherein the at least one component that is not present in a fresh pretreatment composition comprises (b).

2. The method of claim 1, wherein the replenisher composition further comprises (c) a dissolved metal ion comprising a Group IB metal, Group JIB metal, Group VIIB metal, Group VIII metal, Lanthanide Series metal, or combinations thereof.

3. The method of claim 2, wherein the dissolved metal ion of component (c) comprises manganese, cerium, cobalt, copper, zinc, or combinations thereof.

4. The method of claim 2, wherein component (c) is present in the replenisher composition at a weight ratio of 1:10 to 10:1 based on weight of total metal ions of components (a) and (b) to weight of total metal ions of component (c).

5. The method of claim 1, wherein at least 8 percent by weight of total metal ions of components (a) and (b) present in the replenisher composition are provided by component (b).

6. The method of claim 5, wherein component (b) is present in the replenisher composition in an amount ranging from 8 to 90 percent by weight metal ions based on weight of total metal ions of components (a) and (b) of the replenisher composition.

7. The method of claim 1, wherein component (a) of the replenisher composition comprises $H_2TiF_6$, $H_2ZrF_6$, $H_2HfF_6$, $H_2SiF_6$, $H_2GeF_6$, $H_2SnF_6$, or combinations thereof.

8. The method of claim 1, wherein component (a) is present in the replenisher composition in an amount ranging from 10 to 92 percent by weight metal ions based on weight of total metal ions of components (a) and (b) of the replenisher composition.

9. The method of claim 1, wherein the metal of component (b) comprises titanium, zirconium, hathium, aluminum, silicon, germanium, tin, or combinations thereof.

10. The method of claim 1, wherein component (b) comprises zirconium basic carbonate, aluminum hydroxide, tin oxide, silicon hydroxide, or combinations thereof.

11. The method of claim 1, wherein the fresh pretreatment composition comprises:

water and (i) a dissolved complex metal fluoride ion wherein the metal ion comprises a Group IIIA metal, Group IVA metal, Group IVB metal, Group VB metal, or combinations thereof.

12. The method of claim 1, wherein the fresh pretreatment composition comprises:

(i) a dissolved complex metal fluoride ion wherein the metal ion comprises a Group IIIA metal, Group IVA metal, Group IVB metal, Group VB metal, or combinations thereof;

(ii) a dissolved metal ion comprising a Group IB metal, Group JIB metal, Group VIIB metal, Group VIII metal, Lanthanide Series metal, or combinations thereof; and water.

13. The method of claim 12, wherein the dissolved complex metal fluoride ion (i) of the fresh pretreatment composition is the same as the dissolved complex metal fluoride ion (a) of the replenisher composition.

14. The method of claim 12, wherein the metal ion of the dissolved complex metal fluoride ion (i) of the fresh pretreatment composition comprises titanium, zirconium, hafnium, silicon, germanium, tin, or combinations thereof.

15. The method of claim 1, wherein the replenisher composition is added at an amount sufficient to maintain a concentration of metal ions from the dissolved complex metal fluoride ion (i) in the pretreatment bath from 10 ppm to 250 ppm metal ions.

16. The method of claim 12, wherein the dissolved metal ion (ii) of the fresh pretreatment composition is the same as a dissolved metal ion (c) of the replenisher composition comprising a Group IB metal, Group JIB metal, Group VIIB metal, Group VIII metal, Lanthanide Series metal, or combinations thereof.

17. The method of claim 12, wherein the dissolved metal ion (ii) of the fresh pretreatment composition comprises manganese, cerium, cobalt, copper, zinc, or combinations thereof.

18. The method of claim 1, wherein the replenisher composition is added to the bath containing the spent pretreatment composition at an amount sufficient to maintain the metal ions in the bath at a concentration within 25 ppm (measured as elemental metal) of an initial concentration of the metal ions prior to a pretreatment process.

19. The method of claim 1, wherein the replenisher composition is added to the bath containing the spent pretreatment composition at an amount sufficient to maintain the metal ions in the bath at a concentration from 10 to 250 ppm (measured as elemental metal).

20. A method of replenishing a spent pretreatment composition comprising:

adding to a pretreatment bath containing the spent pretreatment composition a replenisher composition having at least one component that is not present in a fresh pretreatment composition, wherein the replenisher composition comprises:

(a) a component comprising $H_2TiF_6$, $H_2ZrF_6$, $H_2HfF_6$, $H_2SiF_6$, $H_2GeF_6$, $H_2SnF_6$, or combinations thereof; and (b) a component comprising an oxide, hydroxide, or carbonate of titanium, zirconium, hafnium, aluminum, silicon, germanium, tin, or combinations thereof, wherein at least one component that is not present in a fresh pretreatment composition comprises (b).

21. The method of claim 20, wherein the replenisher composition further comprises: (c) a dissolved metal ion comprising manganese, cerium, cobalt, copper, zinc, or combinations thereof.

22. The method of claim 20, wherein the fresh pretreatment composition comprises:

(i) a dissolved metal fluoride ion wherein the metal ion comprises a Group IIIA metal, Group IVA metal, Group IVB metal, Group VB metal, or combinations thereof; and water.

23. The method of claim 20, wherein the fresh pretreatment composition comprises:

(i) a dissolved complex metal fluoride ion wherein the metal ion comprises a Group IIIA metal, Group IVA metal, Group IVB metal, Group VB metal, or combinations thereof;

(ii) a dissolved metal ion comprising a Group IB metal, Group JIB metal, Group VIIB metal, Group VIII metal, Lanthanide Series metal, or combinations thereof; and water.

24. The method of claim 20, wherein the replenisher composition is added to the bath containing the spent pretreatment composition at an amount sufficient to maintain metal ions from component (a) at a concentration within 25 ppm (measured as elemental metal) of an initial concentration of the metal ions prior to a pretreatment process.

25. The method of claim 20, wherein the replenisher composition is added to the bath containing the spent pretreatment composition at an amount sufficient to maintain metal ions from component (a) in the bath at a concentration from 10 to 250 ppm (measured as elemental metal).

* * * * *